US009601293B2

(12) United States Patent
Takeda

(10) Patent No.: US 9,601,293 B2
(45) Date of Patent: Mar. 21, 2017

(54) TEMPERATURE SWITCH

(75) Inventor: Hideaki Takeda, Saitama (JP)

(73) Assignee: Uchiya Thermostat Co., Ltd., Saitama-Ken (JP)

( * ) Notice: Subject to any disclaimer, the term of this patent is extended or adjusted under 35 U.S.C. 154(b) by 342 days.

(21) Appl. No.: 14/125,437

(22) PCT Filed: May 25, 2012

(86) PCT No.: PCT/JP2012/063428

§ 371 (c)(1),
(2), (4) Date: Dec. 11, 2013

(87) PCT Pub. No.: WO2013/005496

PCT Pub. Date: Jan. 10, 2013

(65) Prior Publication Data

US 2014/0111299 A1 Apr. 24, 2014

(30) Foreign Application Priority Data

Jul. 4, 2011 (JP) ..... 2011-148257

(51) Int. Cl.
*H01H 37/52* (2006.01)
*H01H 61/01* (2006.01)
(Continued)

(52) U.S. Cl.
CPC ..... *H01H 61/01* (2013.01); *H01H 37/52* (2013.01); *H01H 37/5427* (2013.01);
(Continued)

(58) Field of Classification Search
CPC .... H01H 37/52; H01H 37/5427; H01H 61/01; H01H 2001/5883; H01H 2037/5463; H01H 2037/5481
(Continued)

(56) References Cited

U.S. PATENT DOCUMENTS 3,818,406 A * 6/1974 Klein ..... H01H 85/044 337/146
4,033,029 A * 7/1977 Wolfe ..... H01H 11/00 29/622
(Continued)

FOREIGN PATENT DOCUMENTS

CN 1287373 A 3/2001
DE 19703758 A1 7/1997
(Continued)

OTHER PUBLICATIONS

"Japanese Application Serial No. 201280028520.2, Office Action maield May 27, 2015", 2 pgs.
(Continued)

*Primary Examiner* — Anatoly Vortman
*Assistant Examiner* — Jacob Crum
(74) *Attorney, Agent, or Firm* — Schwegman Lundberg & Woessner, P.A.

(57) ABSTRACT

A base member includes a terminal fixing part for blocking an entire surface of an opening part of a housing at a position further inner than an opening end part of the housing when the base member is inserted in the housing. A first electrode part formed by a tip part of two bent stages that are composed of a horizontal part, a vertical part, and a horizontal part and configured by bending a portion of a part of the fixed side fixed a conductive member, which is continuous with a first external connection terminal, in a direction perpendicular to a continuous direction.

10 Claims, 4 Drawing Sheets

(51) Int. Cl.
*H01H 37/54* (2006.01)
*H01H 1/58* (2006.01)

(52) U.S. Cl.
CPC ..... *H01H 2001/5883* (2013.01); *H01H 2037/5463* (2013.01); *H01H 2037/5481* (2013.01)

(58) Field of Classification Search
USPC ..... 337/362
See application file for complete search history.

(56) References Cited

U.S. PATENT DOCUMENTS

| | | | | | |
|---|---|---|---|---|---|
| 4,278,960 | A * | 7/1981 | Muller | H01H 37/5427 | 337/365 |
| 4,317,097 | A * | 2/1982 | Hofsass | H01H 37/5427 | 337/265 |
| 4,563,667 | A * | 1/1986 | Hofsass | H01H 37/5427 | 337/349 |
| 5,233,325 | A | 8/1993 | Takeda | | |
| 5,489,762 | A | 2/1996 | Martin et al. | | |
| 5,506,379 | A | 4/1996 | McLean, Jr. et al. | | |
| 5,611,717 | A * | 3/1997 | Joly | H01R 13/14 | 439/252 |
| 5,804,798 | A * | 9/1998 | Takeda | H05B 1/0213 | 219/494 |
| 6,346,796 | B1 | 2/2002 | Takeda | | |
| 6,396,381 | B1 * | 5/2002 | Takeda | H01H 1/504 | 337/342 |
| 6,414,285 | B1 | 7/2002 | Takeda | | |
| 7,187,257 | B2 * | 3/2007 | Mochizuki | H01H 50/14 | 335/128 |
| 8,384,334 | B2 | 2/2013 | Takeda | | |
| 2002/0130755 | A1 * | 9/2002 | Takasugi | H01H 37/04 | 337/333 |
| 2009/0186507 | A1 * | 7/2009 | Watanabe | H01R 4/185 | 439/282 |
| 2011/0164340 | A1 | 7/2011 | Takeda | | |
| 2012/0309240 | A1 | 12/2012 | Yang et al. | | |

FOREIGN PATENT DOCUMENTS

| | | | |
|---|---|---|---|
| JP | 4-14338 | U | 2/1992 |
| JP | 07-326268 | A | 12/1995 |
| JP | 11-120853 | A | 4/1999 |
| JP | 11-260221 | A | 9/1999 |
| JP | 2000-299049 | A | 10/2000 |
| JP | 2001-118479 | A | 4/2001 |
| JP | 2002-515166 | A | 5/2002 |
| JP | 2005-237124 | A | 9/2005 |
| WO | WO-2010/038339 | A1 | 4/2010 |
| WO | WO-2011/067705 | A1 | 6/2011 |
| WO | WO-2013/005496 | A1 | 1/2013 |

OTHER PUBLICATIONS

"Japanese Application Serial No. 2013-522534, Office Action mailed Aug. 25, 2015", (w/ English Translation), 11 pgs.
"International Application Serial No. PCT/JP2012/063428, International Search Report mailed Jun. 19, 2012", (2 pgs.).
"Chinese Application Serial No. 201280028520.2, Office Action mailed May 27, 2015", 2 pgs.
"International Application Serial No. PCT/JP2012/063428, International Preliminary Report on Patentability dated Jan. 7, 2014", (w/ English Translation), 8 pgs.
"International Application Serial No. PCT/JP2012/063428, Written Opinion mailed Jun. 19, 2012", (w/ English Translation), 6 pgs.
"Machine Translation of JP 2001-118479A, published on Apr. 27, 2001", 9 pgs.
"German Application Serial No. 112012002848.1, Office Action dated May 6, 2016", (w/ English Translation), 15 pgs.

* cited by examiner

F-F CROSS-SECTION

C-C CROSS-SECTION

D-D CROSS-SECTION

TEMPERATURE SWITCH

RELATED APPLICATIONS

This application is a U.S. National Stage Filing under 35 U.S.C. §371 of International Application No. PCT/JP2012/063428, filed on May 25, 2012, and published as WO 2013/005496 A1 on Jan. 10, 2013, which claims priority to Japanese Application No. 2011-148257, filed Jul. 4, 2011, which applications and publications are incorporated herein by reference in their entirety.

TECHNICAL FIELD

The present invention relates to a temperature switch for interrupting an electric current of an electric appliance by operating when the electric appliance is overheated or an overcurrent occurs.

BACKGROUND ART

Conventionally, an electric current that flows into a current circuit for rotating a motor increases when a mechanical load becomes heavy in an electric appliance that uses the motor as a power source. Moreover, when the load becomes excessively heavy, rotations of the motor are extremely slowed down or stopped.

When the rotations of the motor are extremely slowed down or stopped as described above, an electric current further increases. As a result, the motor produces heat and shortcircuits or burns out a coil, so that the motor is destroyed.

To protect the motor by preventing such a problem, a protector is used to immediately interrupt a current applied to a driving circuit of the motor by sensing heat or a current when the motor excessively produces heat or the current of the driving circuit of the motor excessively increases.

Such a protector is called diversely, such as a temperature switch, a thermal protector, or the like. For example, a heat protector, which is configured to be suitable for a safety backup of an electric appliance that needs less components and assembly operations and utilizes a heating element of a covered type, uses iron as a cover of a main body of the switch, and takes the shape of a swaged terminal in order to facilitate a connection between the terminal and a lead wire, is proposed (for example, see Patent Document 1).

Additionally, it is essential that the position of a fixed contact, which is one of members that configure a switch unit, is fixed as its name represents and not moved by an external factor such as vibrations or the like. As such an example, a directly connected yoke terminal configured to be fixed to a base by bending a stake arm (fixed arm) integrated with the yoke terminal (fixed contact) as one body when being attached to the base is proposed (for example, see Patent Document 2).

Incidentally, a temperature switch as a motor protector is installed for a winding of a motor, and needs to prevent a temperature of the winding from exceeding a temperature limit due to an overload or an overcurrent. With this installation, the temperature switch is directly attached to the winding in some cases. Accordingly, the temperature switch needs to have an insulative property bearable for such attachment.

In such a case, for the protector having an outer covering of a conductive member shaped like an iron cover as in the protector referred to in Patent Document 1, it is needed to attach a connection part between a terminal and a lead wire to a coil of a motor after the connection part is insulated with an insulation tube or the like. If possible, it is preferable to cover also the outer covering with an insulation member.

Additionally, as referred to in Patent Document 2, it is needed to insulate the entire protector inclusive of a swaged part, a terminal linked to the swaged part, and a lead wire after the terminal is swaged and the lead wire is connected when the lead wire is connected to the terminal.

Consequently, a problem of causing difficulty in fixing the protector to the coil of the motor is posed since the size of the entire protector increases when a large-sized insulation member is added as described above. To solve this problem, the issue of insulation is relieved by configuring the main body of the protector with an insulative resin housing.

Namely, it is sufficient to insulate only the swaged part, and the terminal connected to the swaged part, and the lead wire so that a non-insulative part is not exposed outside the resin housing.

PRIOR ART DOCUMENTS

Patent Documents

Patent Document 1: Japanese Laid-open Patent Publication No. HEI07-326268

Patent Document 2: Japanese National Publication of International Patent Application No. 2002-515166

SUMMARY OF THE INVENTION

Problems to be Solved by the Invention

Incidentally, external forces in various directions are applied to a terminal part via a lead wire while the lead wire is being connected or when a switch is incorporated in an electric appliance such as a motor or the like. Therefore, the protector needs to have an entire configuration for bearing the external forces and preventing them from affecting the placement of components within the switch.

Especially, when an outer covering or frame of a main body of the switch is configured with a resin case by giving a priority to the insulation property and a switch is attempted to be further downsized, external forces applied to a terminal distort an internal configuration with more ease. This is because resin is not a rigid material like a metal. Accordingly, the placement of the internal configuration can be affected with high possibility.

However, according to both Patent Documents 1 and 2, the outer covering or frame of the main body of the switch is made of a rigid metal, and components are securely fixed to the frame, thereby eliminating the need for taking, into account, ill effects that the external forces applied to the terminal exert on the placement of the internal configuration. Therefore, Patent Documents 1 and 2 do not refer to the external forces applied to the terminal.

The present invention aims at solving the above described conventional problem, and an object thereof is to provide a temperature switch that has an outer covering or frame made of a resin superior in an insulative property and does not exert ill effects of external forces applied to a terminal on placement of an internal configuration while the terminal part and a lead terminal are being connected or when the temperature switch is incorporated in an electric appliance.

Means for Solving the Problems

To solve the above described problem, a temperature switch according to the present invention includes a housing that is sealed by a sealing member and made of an insulative resin, a base member that is accommodated within the housing and made of an insulative resin, and an electric current path that is molded and integrated with the base member as one body and held by the base member. In the temperature switch that opens an electric contact of an energized circuit to an electric appliance when a temperature of the electric appliance exceeds a specified temperature: the base member includes a terminal fixing part for blocking an entire surface of an opening part of the housing at a position further inner than an opening end part of the housing when the base member is inserted in the housing; the sealing member is made of a liquid curable resin, and seals the opening of the housing at the position further inner than the opening end part of the housing by covering an entire surface of the terminal fixing part of the base member; and the current path includes a first external connection terminal, a fixed side fixed conductive member continuous with the first external connection terminal as one body, a first electrode part formed by a tip part of two bent stages that are composed of a horizontal part, a vertical part, and a horizontal part and configured by bending a portion of a part of the fixed side fixed conductive member, which is continuous with the first external connection terminal, in a direction perpendicular to a continuous direction, a fixed contact attached to the first electrode part, a movable contact arranged to face the fixed contact and to make contact with the fixed contact at a specified temperature or lower, a movable plate for holding a thermal reaction element, a warpage direction of which is inverted when the specified temperature is exceeded, on a side opposite to aside to which the movable contact is attached, a intermediate fixed plate, provided with a tongue piece on one of sides at an end opposite to a holding part, for fixing and holding an end opposite to an end to which the movable contact of the movable plate is attached, a second electrode part connected to the tongue piece of the intermediate fixed plate, a movable side fixed conductive member continuous with the second electrode part as one body, and a second external connection terminal formed by an extension part of the movable side fixed conductive member.

Additionally, in this temperature switch, for example, the sealing member forms a sealed surface vertical to an interior surface of the housing, and the first external connection terminal and the second external connection terminal respectively extend externally from the sealing member by penetrating into the sealing member vertically to the sealed surface of the sealing member from the interior surface of the housing at a position where a clearance corresponding to a thickness of an insulation tube is left, a cross-section, perpendicular to an axis, of the first external connection terminal and the second external connection terminal is formed to take the shape of V or U from a portion nearly immediately after the terminal extends externally from the sealing member to a tip part, an extremity of the first external connection terminal and the second external connection terminal is formed as a lead wire swaged terminal, and one or more cutout parts are formed on a side of a portion between the extremity and the sealing member.

Furthermore, in this temperature switch, for example, a portion of the first external connection terminal, which is arranged within the housing, the fixed side fixed conductive member, a portion of the second external connection terminal, which is arranged within the housing, the movable side fixed conductive member, and the base member are integrated into one body with insert molding, and the first external connection terminal and the second external connection terminal are respectively formed by being bent into two stages composed of a horizontal part continuous with a tip part, a vertical part, and a horizontal part in an axis direction, an inner side of the horizontal part continuous with the tip part is formed as a flat plate from a position before the horizontal part externally penetrates into the sealing member in a state where the horizontal part penetrates into the sealing member and is drawn into the housing.

Still further, in this temperature switch, for example, the vertical part, succeeding the horizontal part continuous with the tip part, of the portion formed by being bent into the two stages includes a protrusion part that extends further upper than the horizontal part on both of sides, and the portion formed by being bent into the two stages, and the protrusion part are buried in the terminal fixing part of the base member.

Still further, in this temperature switch, for example, the base member is provided with extension parts that extend from both of ends of an inner surface of the terminal fixing part toward the inside of the housing, and the extension parts have a length double or more of a thickness of the terminal fixing part in a depth direction of the housing, and a width that does not exceed the thickness, and a portion or a whole of a top surface or a bottom surface makes contact with the interior surface of the housing.

Still further, in this temperature switch, for example, the base member is provided with, in a central portion of an outer surface of the terminal fixing part, a protrusion part having a length that is equal to or longer than the thickness of the terminal fixing part in the depth direction of the housing and a width that does not exceed the thickness, is externally exposed by penetrating into the sealing member, and has the externally exposed tip part that is aligned on the same vertical plane as the opening part end surface of the housing, and the protrusion part is provided with a cutout groove corresponding to a sealing thickness of the sealing member at a top and a bottom of the root of the terminal fixing part.

Still further, in this temperature switch, for example, the first external connection terminal and the second external connection terminal are respectively connected to the lead wire swaged terminal by swaging a lead wire, and attached with an insulation tube having a length needed for insulation inclusive of a connection portion with the lead wire, the insulation tube is inserted until it reaches the sealed surface of the sealing member, and is fixed to an insulation portion by being contracted and cured with heating, and the temperature switch is incorporated in the electric appliance in a state where complete insulation with no exposed portions in a conductive portion is maintained.

Effects of the Invention

The present invention can provide a temperature switch that has an outer covering or frame made of a resin superior in an insulative property and does not exert external forces applied to a terminal on placement of an internal configuration while the terminal part and a lead wire are being connected or when the switch is incorporated in an electric appliance.

BEST MODE OF CARRYING OUT THE INVENTION

Figure 1A:
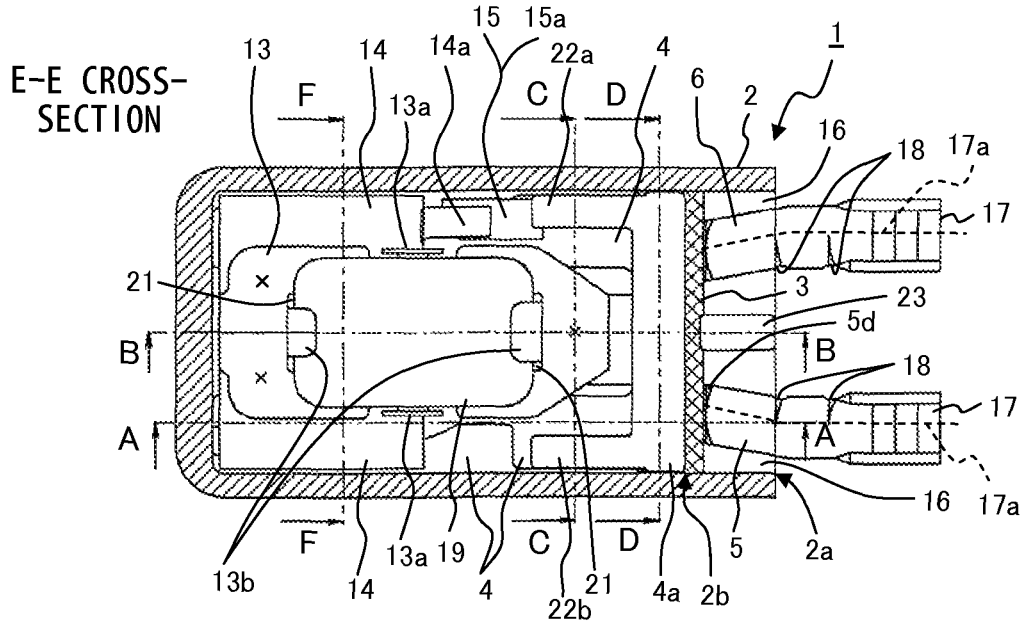
FIG. 1A is a top cross-sectional view of a temperature switch according to a first embodiment of the present invention, and illustrates an E-E cross-sectional view taken in FIG. 1B.

An embodiment according to the present invention is described in detail below with reference to the drawings.

First Embodiment

As illustrated in FIGS. 1A, 1B, 1C, 2A, 2B, and 2C, a temperature switch 1 according to a first embodiment of the present invention includes a housing 2 that is provided with an opening sealed by a sealing member 3 and made of an insulative resin.

Inside the housing 2 made of the insulative resin, a base member 4 made of an insulative resin, and components that are integrated with the base member 4 as one body with insert molding and are held by the base member 4 are accommodated.

The base member 4 has a terminal fixing part 4*a* that forms a surface vertical to an interior surface of the housing 2 at a position 2*b* further inner than an opening end part 2*a* of the housing 2 when the base member 4 is inserted into the housing 2 and blocks the entire opening of the housing 2.

The sealing member 3 is made of a liquid curable resin, is cured by being injected into the vertical surface of the base member 4 to be nearly evenly thick, and seals the opening of the housing 2 vertically to the interior surface of the housing 2 at the position 2*b* further inner than the opening end part 2*a* of the housing 2 by covering the entire vertical surface of the terminal fixing part 4*a* of the base member 4.

As components that are integrated with the base member 4 as one body and held by the base member 4, a first external connection terminal 5 and a second external connection terminal 6 are provided. A current path is formed between the first external connection terminal 5 and the second external connection terminal 6 as illustrated in a block diagram of FIG. 3.

Figure 3:
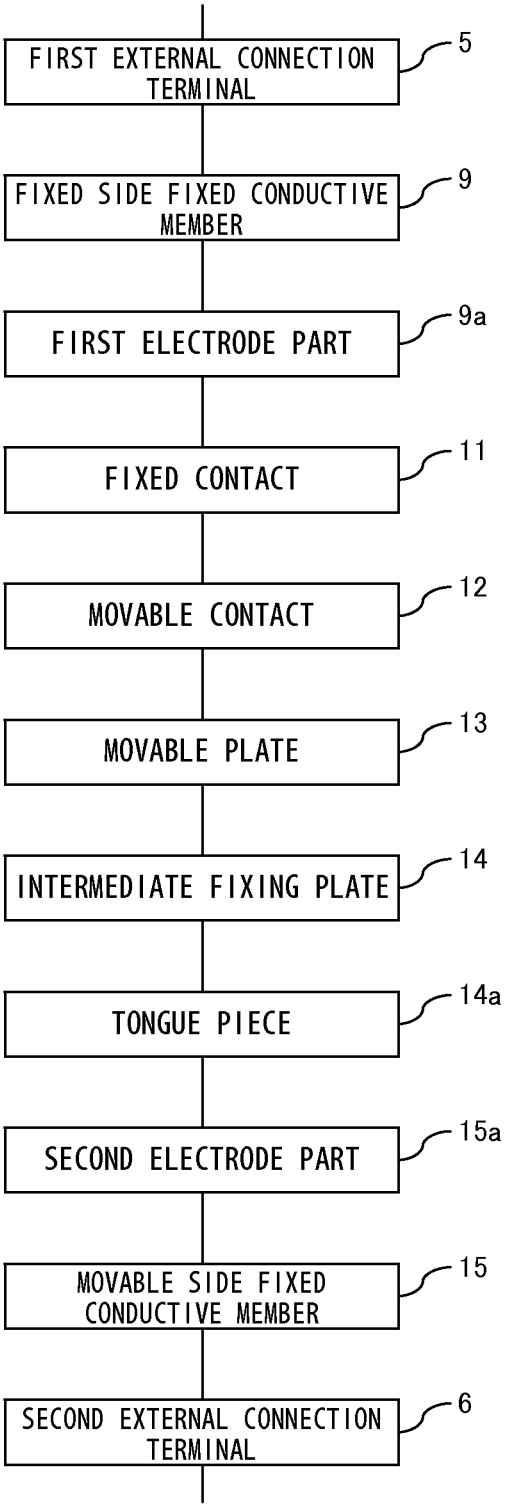
FIG. 3 is a block diagram illustrating a current path of the temperature switch according to the first embodiment.

As illustrated in FIG. 3, the current path is formed by the first external connection terminal 5, a fixed side fixed conductive member 9, a first electrode part 9*a*, a fixed contact 11, a movable contact 12, a movable plate 13, an intermediate fixing plate 14, a tongue piece 14*a*, a second electrode part 15*a*, a movable side fixed conductive member 15, and the second external connection terminal 6.

Figure 1B:
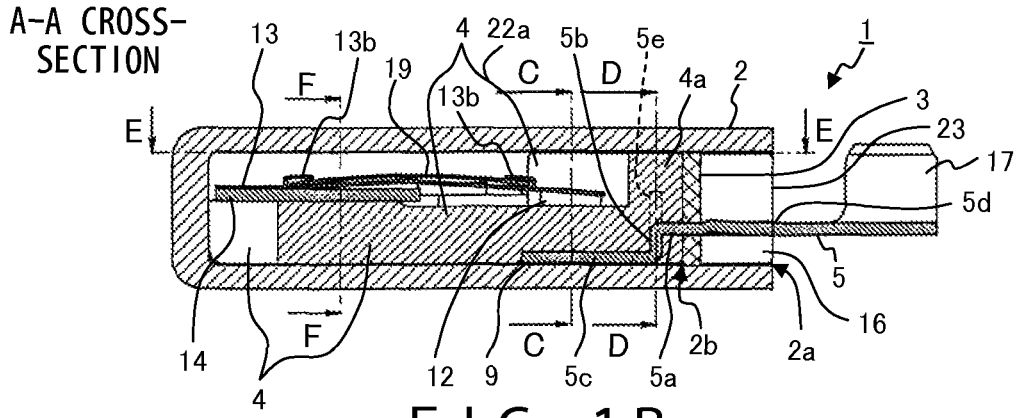
FIG. 1B is an A-A cross-sectional view taken in FIG. 1A.

As illustrated in FIG. 1B, the first external connection terminal 5 externally extends vertically to the surface sealed by the sealing member 3 from the interior surface of the housing 2 at a position where a clearance 16 corresponding to a thickness of an insulation tube (not illustrated) is left with respect to the surface sealed by the sealing member 3 in FIGS. 1A and 1B.

Additionally, an extremity of a portion of the first external connection terminal 5, which externally extends from the sealing member 3, is formed as a lead wire swaged terminal 17.

Furthermore, a cross-section, perpendicular to an axis, of the first external connection terminal 5 is formed to take the shape of V or U from a position 5*d* nearly immediately before the terminal protrudes externally from the sealing member 3 to the tip part (a root of the lead wire swaged terminal 17). In FIG. 1A, the center of the shape V or U is indicated with a broken line 17*a*.

Still further, one or more cutout parts 18 are formed on a side of a portion of the first external connection terminal 5 between the extremity and the sealing member 3.

Since the cutout parts 18 are formed, they absorb external forces even if the forces that bend the tip part of the terminal, namely, the lead wire swaged terminal 17 in right and left directions are applied. This eliminates an ill effect of distorting an internal structure of the terminal.

Additionally, the portion of the first external connection terminal 5, which is arranged within the housing 2, is formed by being bent into two stages composed of a horizontal part 5*a* continuous with the tip, a vertical part 5*b*, and a horizontal part 5*c* in an axis direction of the terminal as illustrated in FIG. 1B.

When viewed from a different angle, the horizontal part 5*a* continuous with the tip is drawn into the housing 2 by externally penetrating into the sealing member 3. Moreover, the inner side from the position 5*d* immediately before the horizontal part 5*a* externally penetrates into the housing 2 is formed as a flat plate.

As described above, the inner side from the position 5*d* immediately before the first external connection terminal 5 externally penetrates into the sealing member 3 is formed as the flat plate. Therefore, even if external forces that bend the tip part of the terminal, namely, the lead wire swaged terminal 17 upward or downward are applied, the portion formed as the flat plate absorbs the external forces. This eliminates the fear of distorting the internal structure of the terminal.

The terminal fixing part 4*a* of the base member 4, which is present on the side further inner than the sealing member 3 and makes close contact with the sealing member 3, is provided with internal extension parts 22 (22*a*, 22*b*) that extend from both of ends of the terminal fixing part 4*a* toward the inner side of the housing 2.

The two internal extension parts 22 are formed to avoid the contacts and a mechanical part of the movable plate 13 and to extend along an interior wall of the housing on both of sides of the contacts and the mechanical part of the movable plate 13 within the housing 2.

The entire surface of the top of the internal extension parts 22 may be configured to make contact with an interior surface of the top of the housing 2, or a portion including the tip of the extension part may be configured to make contact with the interior surface of the top of the housing 2 and create a clearance in an intermediate portion from the root of the internal extension part 22 to the tip.

In either configuration, the internal extension parts 22 are present to implement the function of preventing the terminal fixing part 4*a* from being displaced so that the terminal fixing part 4*a* falls in neither the internal direction nor the external direction.

In addition to the internal extension parts 22, a structure for strengthening the terminal fixing part 4*a* may be provided outside the base member 4. Namely, an external extension part 23 is formed to extend up to the opening end part of the housing 2 by penetrating into the sealing member 3 from the center of the exterior surface of the terminal fixing part 4*a*.

It is preferable that top and bottom surfaces of the external extension part 23 and those of the terminal fixing part 4*a* are nearly on the same plane. Moreover, the top and the bottom surfaces of the external extension part 23 are configured to always make contact with the interior surfaces of the top and the bottom of the housing 2, or to make contact with the interior surfaces of the top and the bottom of the housing 2 when an external force is applied to the first external connection terminal or the second external connection terminal.

Thus, the function of preventing the terminal fixing part 4*a* from being displaced so that the terminal fixing part 4*a* falls in neither the internal direction nor the external direction is strengthened in addition to the function of the internal extension parts 22. Note that cutout parts 23*a* are provided at the top and the bottom of the root part from which the external extension part 23 protrudes from the terminal fixing part 4*a*.

To seal the sealed surface, the sealing member 3 needs to be filled at the entire edge of the sealed surface along the sealed surface. If the external extension part 23 protrudes from the terminal fixing part 4*a* as it is, the sealing member 3 becomes discontinuous at the root of the external extension part 23, so that the sealed surface is not completely sealed.

However, by providing the above described cutout parts 23*a*, the sealing member 3 goes into the cutout parts 23*a* when the liquid sealing member 3 is injected into the sealed surface of the terminal fixing part 4*a*, so that the sealing member 3 becomes continuous at the entire edge part of the sealed surface.

As a result, the main body of the switch that is integrated with the base member 4 as one body can be completely sealed within the housing 2 when the liquid sealing member 3 is cured after heated.

Note that the external extension part 23 has a function of preventing exposed portions of both of the terminal parts from making contact with each other when a lead wire is swaged to the lead wire swaged terminal 17 of the first external connection terminal 5 and the second external connection terminal 6 and when the first external connection terminal 5 and the second external connection terminal 6 are covered with an insulation tube in addition to the function of securely fixing the position of the terminal fixing part 4*a*.

Here, a protrusion part 5*e* that extends further upper than the horizontal part 5*a* is formed on both of sides of the vertical part 5*b* in the portion bent into the two stages composed of the above described horizontal part 5*a*, vertical part 5*b*, and horizontal part 5*c* of the first external connection terminal 5 as illustrated in FIG. 1B.

Additionally, the portion bent into the two stages composed of the horizontal part 5*a*, the vertical part 5*b*, and the horizontal part 5*c*, and the protrusion part 5*e* are buried in the terminal fixing part 4*a* of the base member 4.

As described above, the portion where the two stages composed of the horizontal part 5*a*, the vertical part 5*b*, and the horizontal part 5*c*, and the protrusion part 5*e* of the first external connection terminal 5 are formed is held by the terminal fixing part 4*a* of the base member 4 by being buried as one integrated body.

Furthermore, the position of the terminal fixing part 4*a* of the base member 4 is securely fixed to the housing 2 by the two internal extension parts 22*a*, 22*b*, and the external extension part 23 at the center as described above.

Accordingly, external forces are impeded by the terminal fixing part 4*a* even if an externally pulling or pressing force in the axis direction of the terminal is applied to the lead wire swaged terminal 17 at the tip part of the first external connection terminal 5, thereby preventing the internal configuration from being distorted.

Figure 1C:
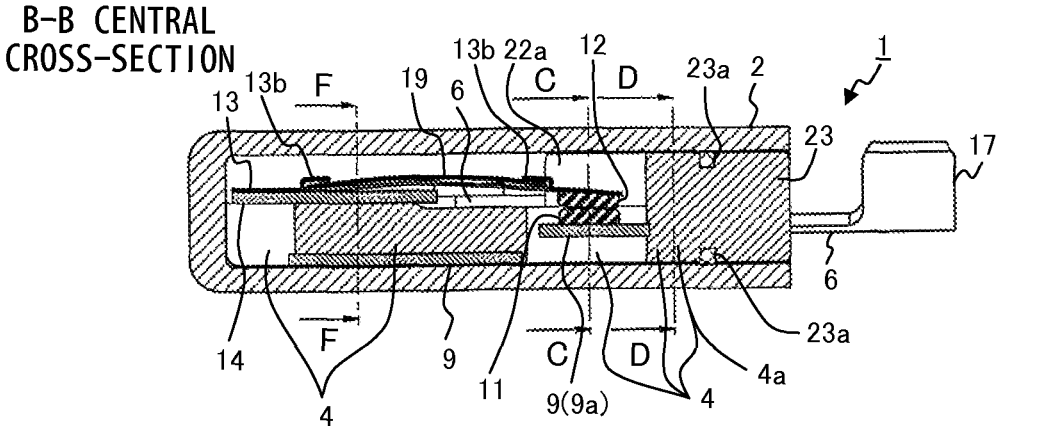
FIG. 1C is a B-B cross-sectional view taken in FIG. 1A.

Also the shape and the placement of the second external connection terminal 6 are similar to those of the first external connection terminal 5 although the above described shape and placement of the first external connection terminal 5 are not viewed in the second external connection terminal 6 illustrated in FIG. 1C due to a difference in the positions of the cross-sections.

Figure 2A:
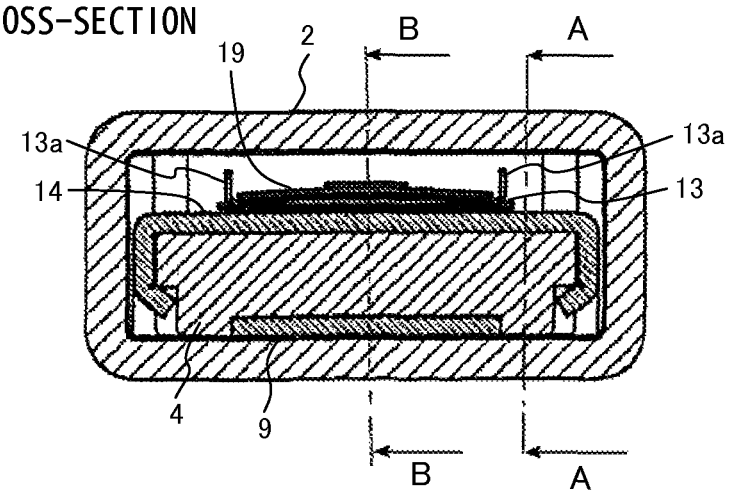
FIG. 2A is an F-F cross-sectional view taken in FIGS. 1B and 1C.

The horizontal part 5*c* of the first external connection terminal 5, which extends toward the innermost part (the left of FIG. 1B) of the housing 2 along the bottom surface of the housing 2, is continuous and integrated, as one body, with the fixed side fixed conductive member 9 illustrated in FIGS. 1B and 2A.

A portion of the fixed side fixed conductive member illustrated in FIG. 1B, which is continuous with the horizontal part 5*c*, once goes into the far side of a depth direction of the paper sheet. Therefore, the portion looks discontinuous in the cross-section illustrated in FIG. 1B.

Figure 2B:
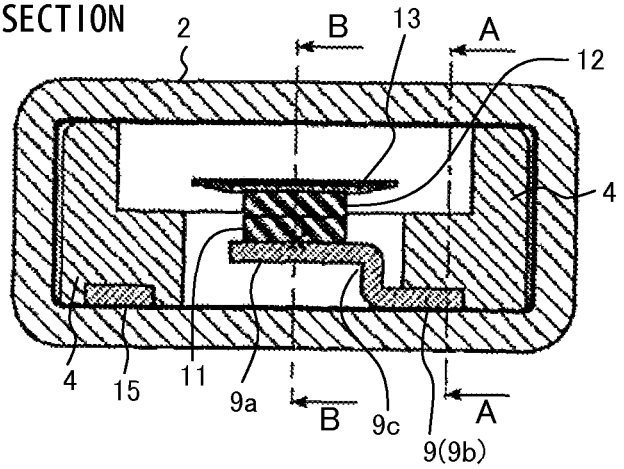
FIG. 2B is a C-C cross-sectional view taken in FIGS. 1B and 1C.
Figure 2C:
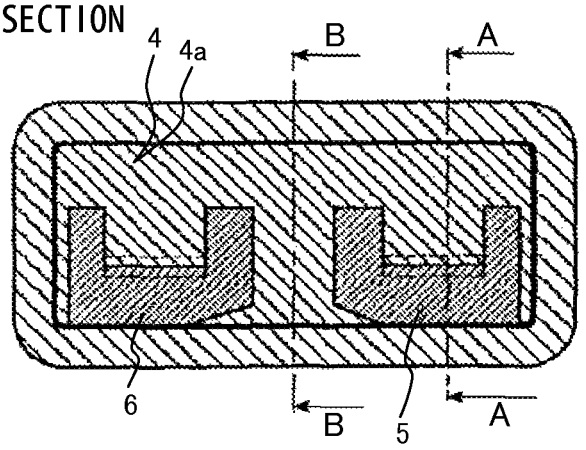
FIG. 2C is a D-D cross-sectional view taken in FIGS. 1B and 1C.

The fixed side fixed conductive member 9 that goes into the far side of the depth direction of the paper sheet in FIG. 1B forms a horizontal part 9*b* as illustrated in FIG. 2B, further extends in a depth (the near side of the depth direction of the paper sheet of FIG. 2B) of the housing 2, and is arranged to largely extend at the center of the bottom surface of the housing 2 in a deeper portion as illustrated in FIG. 2A.

A portion of the fixed side fixed conductive member 9, which is continuous with the first external connection terminal 5, namely, the horizontal part 9*b* illustrated in FIG. 2B is bent into two stages composed of a vertical part 9*c* and the horizontal part 9*a* from the horizontal part 9*b* in a direction (the depth direction of the paper sheet of FIG. 1B, the right and the left direction of FIG. 2B, in other words, the direction perpendicular to the axis direction of the terminal) perpendicular to the continuous direction.

Additionally, a first electrode part (9*a*) is formed by the horizontal part 9*a*, which is the tip part of the two bent stages, as illustrated in FIGS. 1C and 2B. A fixed contact 11 is attached to the first electrode part 9*a*.

As described above, the fixed contact 11 is attached to the tip part of the two bent stages formed in the direction perpendicular to the axis of the terminal in the portion of the fixed side fixed conductive member 9, which is continuous with the first external connection terminal 5.

Accordingly, even if external forces are applied from the lead wire swaged terminal 17 of the first external connection terminal 5, the forces in the upper, the lower, the right, and the left directions are absorbed by flattening the terminal or forming the cutouts as described above. Therefore, a direction where a remaining external force is applied is only the axis direction of the terminal.

It is difficult for the external force in the axis direction of the terminal to propagate to the first electrode part 9*a* (horizontal part 9*a*) at the tip part of the two bent stages formed in the direction perpendicular to the axis of the terminal. Namely, it is no exaggeration to say that there is no possibility of distorting the first electrode part 9*a*, to which the fixed contact 11 is attached, by external forces propagated from the lead wire swaged terminal 17.

The movable contact 12 is arranged to face the fixed contact 11 attached to the first electrode part 9*a*.

The movable contact 12 is attached to one end (the right end of FIGS. 1A, 1B, and 1C) of the movable plate 13. The movable plate 13 is arranged to be upwardly convex in a normal state as illustrated in FIGS. 1B and 1C.

Additionally, the movable plate 13 holds a bimetallic element 19 as a thermal reaction element on a side opposite to the side to which the movable contact 12 is attached. The movable plate 13 is provided with a long hole 21 formed by cutting out a central portion in a long direction as illustrated in FIG. 1A.

Furthermore, the movable plate 13*a* is provided with peg parts 13*a* at both of ends in a short direction on the side opposite to the side to which the movable contact 12 is attached, and also provided with hook parts 13*b* at both of ends of the long hole 21 in the long direction as illustrated in FIGS. 1A, 1B, 1C, and 2A.

Both of the ends of the bimetallic element 19 in the long direction are loosely engaged with the hook parts 13*b* of the movable plate 13*b*, and the positions of both of the ends of the bimetallic element 19 in the short direction are regulated by the peg parts 13*a* of the movable plate 13, so that the bimetalic element 19 is held by the movable plate 13.

The end opposite to that to which the movable contact 12 of the movable plate 13 is attached is fixed to and held by a rear end (the end in the inner direction of the housing 2) at the position of the innermost portion (the left end part of FIG. 1A) of the housing 2.

Additionally, the intermediate fixing plate 14 is provided with a tongue piece 14*a* on one side of the end (the right end part of FIG. 1A) opposite to that holding the movable plate 13 as illustrated in FIG. 1A. To the tongue piece 14*a*, the second electrode part 15*a* is connected.

Similarly to the first external connection terminal 5, the second external connection terminal 6 is formed by being bent into two stages composed of a horizontal part continuous with the tip of the terminal, a vertical part, and a horizontal part in the axis direction of the terminal as stated earlier. The horizontal part cited last forms the aforementioned second electrode part 15*a*.

Namely, the second external connection terminal 6 is connected to the movable contact 12 via the portion formed by being bent into the two stages, the second electrode part 15*a*, the tongue piece 14*a*, the intermediate fixing plate 14, and the movable plate 13. The above described configuration forms the current circuit illustrated in FIG. 3 within the housing 2.

Figure 4:
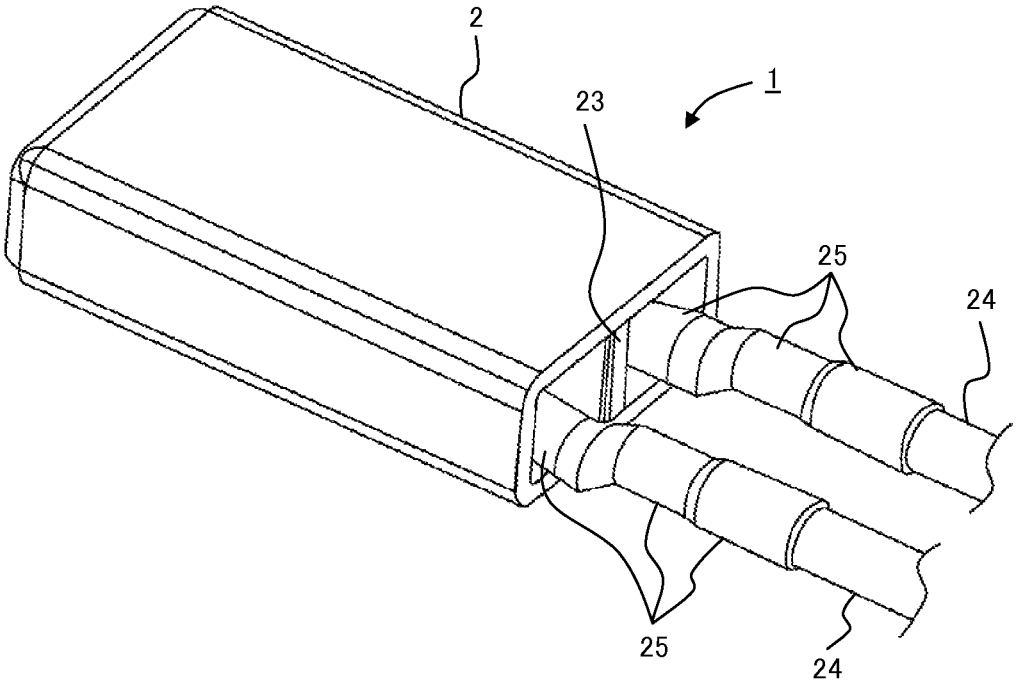
FIG. 4 is a perspective view illustrating a state where insulation tubes having a length needed for insulation inclusive of a connection portion with a lead wire are attached to external connection terminals before the temperature switch according to the first embodiment is incorporated in an electric appliance.

In the temperature switch 1 including the current circuit illustrated in FIG. 3 according to this embodiment, tips (not illustrated), from which an outer sheath of the lead wires 24 illustrated in FIG. 4 is removed, are connected to the lead wire swaged terminal 17 of the first external connection terminal 5 and the lead wire swaged terminal 17 of the second external connection terminal 6 by being swaged or the like before the temperature switch 1 is incorporated in an electric appliance.

Additionally, an insulation tube 25 having a length that is needed for insulation inclusive of a connection portion with the lead wire 24 is attached to each of the first external connection terminal 5 and the second external connection terminal 6 as illustrated in FIG. 4.

Between the interior surface of the housing 2 from the opening end part to the sealed surface and the terminal part that externally extends from the sealed surface, the clearance 16 corresponding to the thickness of the insulation tube 25 is created as described above.

As a result, by inserting the insulation tubes 25 until they reach the sealed surface of the sealing member 3, a completely insulated state with no exposed portions in the conductive part can be secured. The insulation tubes 25 are contracted and cured by being heated, and fixed to the insulated portion.

The temperature switch 1 according to this embodiment is incorporated in an electric appliance by being connected in series with an energized circuit of the electric appliance 24 by the lead wires after the lead wires 24 are swaged and connected to the above described first and second external connection terminals 5 and 6 and the insulation tubes 25 are heated and cured.

A warpage direction of the bimetalic element 19 of the temperature switch 1 is inverted when a temperature of the electric appliance exceeds a specified temperature, so that the end to which the movable contact 12 of the movable plate 13 is attached is lifted to release the movable contact 12 from the contact with the fixed contact 11. Namely, the bimetalic element 19 interrupts a current of an energized circuit by opening the electric contact of the energized circuit of the electric appliance.

As described above, with the temperature switch 1 according to this embodiment, a structure including the entire switch mechanisms part within an insulative resin housing similar to conventional temperature switches can be implemented, and moreover, the insulative structure of a size that is not larger than the main body even after the lead wires are connected to the terminals can be formed.

Additionally, in the case of such a small-sized structure, the strengths of terminals pose a technical challenge. However, a terminal extension part parallel to the sealed surface is provided by forming a vertical part of the two bent stages within the resin of the terminal fixing part, whereby the strengths of the terminals can be secured.

Furthermore, the extension parts having a shape that makes contact with the inner surfaces of the top and the bottom of the housing are provided inside and outside the terminal fixing part. As a result, the strength of fixing the terminal fixing part itself can be secured.

Still further, the portions having changed shapes such as the changed thickness, the cutout parts on the sides, and the like of the terminal shape are provided outside the sealed surface. Therefore, if external forces are applied to the terminals, a stress concentrates on a portion having a corresponding shape, which is then deformed, thereby preventing the terminal fixing part from being destroyed by eternal forces applied to the terminals.

INDUSTRIAL APPLICABILITY

The present invention is applicable to a temperature switch, incorporated in an electric appliance such as a motor or the like, for interrupting an electric current of the electric appliance by operating when the electric appliance is overheated or an overcurrent occurs.

EXPLANATION OF CODES

1 temperature switch
2 housing
2*a* opening end part
2*b* inner position
3 sealing member
4 base member

4*a* terminal fixing part
5 first external connection terminal
5*a* horizontal part
5*b* vertical part
5*c* horizontal part
5*d* position before penetration
5*e* protrusion part
6 second external connection terminal
9 fixed side fixed conductive member
9*a* horizontal part (first electrode part)
9*b* horizontal part
9*c* vertical part
11 fixed contact
12 movable contact
13 movable plate
13*a* peg part
13*b* hook part
14 intermediate fixing plate
14*a* tongue piece
15 movable side fixed conductive member
15*a* second electrode part
16 clearance
17 lead wire swaged terminal
18 cutout part
19 bimetalic element
21 long hole
22 (22*a*,22*b*) internal extension parts
23 external extension part
23*a* cutout part
24 lead wire
25 insulation tube

The invention claimed is:

1. A temperature switch having a housing that is sealed by a sealing member and made of an insulative resin, a base member that is accommodated within the housing and made of an insulative resin, and an electric current path that is molded and integrated with the base member as one body and held by the base member, the temperature switch opening an electric contact of an energized circuit to an electric appliance when a temperature of the electric appliance exceeds a specified temperature, wherein:

the base member comprises a terminal fixing part for blocking an entire surface of an opening part of the housing at a position further inner than an opening end part of the housing when the base member is inserted in the housing;

the sealing member is made of a liquid curable resin, and seals the opening of the housing at the position further inner than the opening end part of the housing by covering an entire surface of the terminal fixing part of the base member; and the current path comprises a first external connection terminal, a fixed side fixed conductive member continuous with the first external connection terminal as one body, a first electrode part formed by a tip part of two bent stages that are composed of a horizontal part, a vertical part, and a horizontal part and configured by bending a portion of a part of the fixed side fixed conductive member, which is continuous with the first external connection terminal, in a direction perpendicular to a continuous direction, a fixed contact attached to the first electrode part, a movable contact arranged to face the fixed contact and to make contact with the fixed contact at a specified temperature or lower, a movable plate for holding a thermal reaction element, a warpage direction of which is inverted when the temperature switch exceeds the specified temperature, on a side opposite to a side to which the movable contact is attached, an intermediate fixing plate, provided with a tongue piece on one side at an end opposite to a holding part, for fixing and holding an end opposite to an end to which the movable contact of the movable plate is attached, a second electrode part connected to the tongue piece of the intermediate fixing plate, a movable side fixed conductive member continuous with the second electrode part as one body, and a second external connection terminal formed by an extension part of the movable side fixed conductive member, wherein the base member is provided with extension parts that extend from both of ends of an inner surface of the terminal fixing part toward the inside of the housing, and the extension parts have a length double or more of a thickness of the terminal fixing part in a depth direction of the housing, and a width that does not exceed the thickness, and a portion or a whole of a top surface or a bottom surface makes contact with the interior surface of the housing.

2. The temperature switch according to claim 1, wherein the sealing member forms a sealed surface vertical to an interior surface of the housing, and the first external connection terminal and the second external connection terminal respectively extend externally from the sealing member by penetrating into the sealing member vertically to the sealed surface of the sealing member from the interior surface of the housing at a position where a clearance corresponding to a thickness of an insulation tube is left, a cross-section, perpendicular to an axis, of the first external connection terminal and the second external connection terminal is formed to take the shape of V or U from a portion nearly immediately after the terminal extends externally from the sealing member to a tip part, an extremity of the first external connection terminal and the second external connection terminal is formed as a lead wire swaged terminal, and one or more cutout parts are formed on a side of a portion between the extremity and the sealing member.

3. A temperature switch having a housing that is sealed by a sealing member and made of an insulative resin, a base member that is accommodated within the housing and made of an insulative resin, and an electric current path that is molded and integrated with the base member as one body and held by the base member, the temperature switch opening an electric contact of an energized circuit to an electric appliance when a temperature of the electric appliance exceeds a specified temperature, wherein:

the base member comprises a terminal fixing part for blocking an entire surface of an opening part of the housing at a position further inner than an opening end part of the housing when the base member is inserted in the housing;

the sealing member is made of a liquid curable resin, and seals the opening of the housing at the position further inner than the opening end part of the housing by covering an entire surface of the terminal fixing part of the base member; and the current path comprises a first external connection terminal, a fixed side fixed conductive member continuous with the first external connection terminal as one body, a first electrode part formed by a tip part of two bent stages that are composed of a horizontal part, a vertical part, and a horizontal part and configured by bending a portion of a part of the fixed side fixed conductive member, which is continuous with the first external connection terminal, in a direction perpendicular to a continuous direction, a fixed contact attached to the first electrode part, a movable contact arranged to face the fixed contact and to make contact with the fixed contact at a specified temperature or lower, a movable plate for holding a thermal reaction element, a warpage direction of which is inverted when the temperature switch exceeds the specified temperature, on a side opposite to a side to which the movable contact is attached, an intermediate fixing plate, provided with a tongue piece on one side at an end opposite to a holding part, for fixing and holding an end opposite to an end to which the movable contact of the movable plate is attached, a second electrode part connected to the tongue piece of the intermediate fixing plate, a movable side fixed conductive member continuous with the second electrode part as one body, and a second external connection terminal formed by an extension part of the movable side fixed conductive member, wherein the base member is provided with, in a central portion of an outer surface of the terminal fixing part, a protrusion part having a length that is equal to or longer than the thickness of the terminal fixing part in the depth direction of the housing and a width that does not exceed the thickness, is externally exposed by penetrating into the sealing member, and has the externally exposed tip part that is aligned on a same vertical plane as an opening part end surface of the housing, and the protrusion part is provided with a cutout groove corresponding to a sealing thickness of the sealing member at a top and a bottom of a root of the terminal fixing part.

4. The temperature switch according to claim 2, wherein the first external connection terminal and the second external connection terminal are respectively connected by swaging a lead wire, and attached with an insulation tube having a length needed for insulation inclusive of a connection portion with the lead wire, the insulation tube is inserted until the insulation tube reaches the sealed surface of the sealing member, and is fixed to an insulation portion by being contracted and cured with heating, and the temperature switch is incorporated in the electric appliance in a state where complete insulation with no exposed portions in a conductive portion is maintained.

5. The temperature switch according to claim 3, wherein the sealing member forms a sealed surface vertical to an interior surface of the housing, and the first external connection terminal and the second external connection terminal respectively extend externally from the sealing member by penetrating into the sealing member vertically to the sealed surface of the sealing member from the interior surface of the housing at a position where a clearance corresponding to a thickness of an insulation tube is left, a cross-section, perpendicular to an axis, of the first external connection terminal and the second external connection terminal is formed to take the shape of V or U from a portion nearly immediately after the terminal extends externally from the sealing member to a tip part, an extremity of the first external connection terminal and the second external connection terminal is formed as a lead wire swaged terminal, and one or more cutout parts are formed on a side of a portion between the extremity and the sealing member.

6. The temperature switch according to claim 5, wherein the first external connection terminal and the second external connection terminal are respectively connected by swaging a lead wire, and attached with an insulation tube having a length needed for insulation inclusive of a connection portion with the lead wire, the insulation tube is inserted until the insulation tube reaches the sealed surface of the sealing member, and is fixed to an insulation portion by being contracted and cured with heating, and the temperature switch is incorporated in the electric appliance in a state where complete insulation with no exposed portions in a conductive portion is maintained.

7. The temperature switch according to claim 1, wherein a portion of the first external connection terminal, which is arranged within the housing, the fixed side fixed conductive member, a portion of the second external connection terminal which is arranged within the housing, the movable side fixed conductive member, and the base member are integrated into one body with insert molding, and the first external connection terminal and the second external connection terminal are respectively formed by being bent into two stages composed of a horizontal part continuous with a tip part, a vertical part, and a horizontal part in an axis direction, an inner side of the horizontal part continuous with the tip part is formed as a flat plate from a position before the horizontal part externally penetrates into the sealing member in a state where the horizontal part penetrates into the sealing member and is drawn into the housing.

8. The temperature switch according to claim 7, wherein the vertical part, succeeding the horizontal part continuous with the tip part, of the portion formed by being bent into the two stages comprises a protrusion part that extends further upper than the horizontal part on both sides, and the portion formed by being bent into the two stages, and the protrusion part are buried in the terminal fixing part of the base member.

9. The temperature switch according to claim 3, wherein a portion of the first external connection terminal, which is arranged within the housing, the fixed side fixed conductive member, a portion of the second external connection terminal, which is arranged within the housing, the movable side fixed conductive member, and the base member are integrated into one body with insert molding, and the first external connection terminal and the second external connection terminal are respectively formed by being bent into two stages composed of a horizontal part continuous with a tip part, a vertical part, and a horizontal part in an axis direction, an inner side of the horizontal part continuous with the tip part is formed as a flat plate from a position before the horizontal part externally penetrates into the sealing member in a state where the horizontal part penetrates into the sealing member and is drawn into the housing.

10. The temperature switch according to claim 9, wherein the vertical part, succeeding the horizontal part continuous with the tip part, of the portion formed by being bent into the two stages comprises a protrusion part that extends further upper than the horizontal part on both sides, and the portion formed by being bent into the two stages, and the protrusion part are buried in the terminal fixing part of the base member.

* * * * *